US007338368B2

(12) United States Patent
Lind et al.

(10) Patent No.: US 7,338,368 B2
(45) Date of Patent: Mar. 4, 2008

(54) METHOD, SYSTEM, AND PROGRAM PRODUCT FOR GROUPING GAME PLAYERS BY CLASS

(75) Inventors: Clifton E. Lind, Austin, TX (US); Jefferson C. Lind, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 392 days.

(21) Appl. No.: 10/752,293

(22) Filed: Jan. 6, 2004

(65) Prior Publication Data

US 2005/0096120 A1 May 5, 2005

Related U.S. Application Data

(60) Provisional application No. 60/515,265, filed on Oct. 29, 2003.

(51) Int. Cl.
*A63F 9/24* (2006.01)

(52) U.S. Cl. ..... 463/19; 463/42

(58) Field of Classification Search ..... 463/16–20, 463/25–30, 40–42; 273/138.1–138.2, 269, 273/274

See application file for complete search history.

(56) References Cited

U.S. PATENT DOCUMENTS 5,569,083 A * 10/1996 Fioretti ..... 463/19
5,577,727 A * 11/1996 Brame et al. ..... 273/139
6,039,648 A * 3/2000 Guinn et al. ..... 463/16
6,082,887 A * 7/2000 Feuer et al. ..... 700/91
6,257,980 B1 * 7/2001 Santini, Jr. ..... 463/19
6,280,325 B1 * 8/2001 Fisk ..... 463/19
6,287,202 B1 * 9/2001 Pascal et al. ..... 463/42
6,585,590 B2 * 7/2003 Malone ..... 463/19
6,604,997 B2 * 8/2003 Saidakovsky et al. ..... 463/9
6,729,956 B2 * 5/2004 Wolf et al. ..... 463/25
6,908,390 B2 * 6/2005 Nguyen et al. ..... 463/42
2004/0152499 A1 8/2004 Lind et al

* cited by examiner

*Primary Examiner*—Robert E Pezzuto
(74) *Attorney, Agent, or Firm*—Russell D. Culbertson; The Culbertson Group, P.C.

(57) ABSTRACT

Game play requests in a bingo gaming system are associated with different play characteristic classes and collected into different game play groups simultaneously according to play characteristic class. Once a sufficient number of game play requests are collected in a respective game play group, a bingo game is conducted with the respective game play group and results are returned to the players associated with that game play group. Play characteristic class may be defined on the basis of the speed at which players take any required actions to claim results in a game so that players who may take the required actions relatively slowly will not be grouped for games with players who may take the required actions relatively quickly.

20 Claims, 10 Drawing Sheets

METHOD, SYSTEM, AND PROGRAM PRODUCT FOR GROUPING GAME PLAYERS BY CLASS

CROSS-REFERENCE TO RELATED APPLICATION

The Applicants claim the benefit, under 35 U.S.C. §119 (e), of U.S. Provisional Patent Application 60/515,265 filed Oct. 29, 2003 and entitled METHOD, SYSTEM, AND PROGRAM PRODUCT FOR GROUPING GAME PLAYERS BY CLASS. The entire content of this provisional application is incorporated herein by this reference.

TECHNICAL FIELD OF THE INVENTION

This invention relates to electronic gaming systems enabling players from many different gaming locations to participate in bingo games. More particularly, the invention is directed to apparatus, methods, and program products for grouping players for various bingo games to facilitate consistently rapid completion of bingo games and to enhance player participation in bingo games.

BACKGROUND OF THE INVENTION

The game referred to generally as "Bingo" is played with predetermined bingo cards that include a number of designations randomly arranged in a grid or other layout of spots or locations. The bingo cards may be physically printed on paper or another suitable material, or may be represented by a data structure that defines the various card locations and designations associated with the locations. In the traditional bingo game sequence, a number of the predetermined bingo cards are put in play for a particular game. After the sale of bingo cards is closed for a given game, designations are randomly selected from a pool of available designations and matched to the designations on each bingo card that is in play in the game. This matching of bingo designations randomly selected for a game and bingo designations associated with a card in play in the game is commonly referred to as daubing the card and results in a pattern or arrangement of matched spots or card locations. Daubing was done manually by the player holding the bingo card in traditional bingo games, and then by a game administrator to verify a win in the game. More recent bingo gaming systems automatically check for winning patterns on a bingo card as designations are randomly selected for a game. Regardless of how the bingo cards in play in a game are daubed, the first card which is daubed in some predefined way is considered a winning card for the game. The predefined way in which a card must be matched or daubed to produce a win in the game is commonly defined in terms of some identifiable pattern of matched or daubed locations on the card.

Although traditional bingo games remain popular, traditional paper bingo games are played relatively slowly. The card purchasing or buy-in period, the sequential ball draw and announcement of each individual designation, and then winner verification together consume a good deal of time. The time required to play a traditional bingo game limits the player excitement with the game and thus limits player satisfaction.

Various systems have been developed to aid players in playing bingo games and to enhance player participation in the games. The MegaMania™ gaming system offered by Multimedia Games, Inc. comprises a bingo gaming system in which players at different gaming facilities over a large geographic area may participate in bingo games. The players participate in bingo games in the MegaMania™ system through electronic player stations that are maintained at various gaming facilities across the United States.

Another networked bingo gaming system is disclosed in U.S. patent application Ser. No. 10/456,721 entitled "Method, System, and Program Product for Conducting Multiple Concurrent Bingo-Type Games," the entire content of which is incorporated herein by this reference. The gaming system disclosed in this patent application groups players rapidly to form quorums for conducting bingo games. Although numerous individual bingo games in this system may be in various stages of completion at any point in time, each individual bingo game is played in the traditional bingo sequence. That is, the players place their card or cards in play, bingo designations are drawn, and then the results for each card in play are identified. In some implementations of this gaming system, the players must take some action to claim the result associated with their card or cards. For example, a player may be required to activate a player control at the player station to daub their card or cards and then may be required to activate a player control at the player station to claim their result or prize. The daubing and result claiming actions may be required especially for the player in a given game that achieves the game ending pattern.

Electronic bingo game systems and electronic player stations may increase the speed at which certain operations in a bingo game may be performed. However, even in electronically implemented bingo games, the manner in which games are played and the player actions required to end a given game may introduce a delay in identifying game results and displaying those results to the various participants in the game. For example, in a bingo game implementation in which the player first achieving the game ending pattern must take some action to claim the win, delay may be introduced into the game when that apparent game ending winner is slow to take the required result claiming action or actions. It is also possible for the apparent game ending pattern winner to fail to take the required action within the provided time. In this case, game rules may require that additional designations be drawn or considered in order to identify a new apparent game ending winner, who is then given time to take the required result claiming actions. Not only does this process of identifying the new apparent winner add delay for that player, but also the additional designations considered may change the results for other players in that game. Thus, there remains a need for increasing the speed of play in bingo gaming systems in order to make the bingo games attractive to players, and especially a need for reducing the delay occasioned by slow players or players who are prone to failing to claim their results.

SUMMARY OF THE INVENTION

The present invention provides apparatus, methods, and program products for conducting bingo type games in a way that may reduce undesirable delays occasioned by slow players or players that fail to claim their game ending results. A method according to the present invention includes associating game play requests in a bingo gaming system with different play characteristic classes and collecting the game play requests into different game play groups simultaneously according to play characteristic class. For example, the system may associate some game play requests with a first play characteristic class and other game play requests with a second play characteristic class. In this example, the system may collect a game play group for the game play requests associated with the first play characteristic class and a separate game play group for the game play requests associated with the second play characteristic class. Once a sufficient number of game play requests are collected in a respective game play group, the method includes conducting a bingo game with the respective game play group.

Grouping the game play requests into game play groups according to play characteristic class allows players to be grouped according to various characteristics that may enhance the players' gaming experience. In particular, game play requests initiated by relatively fast playing players may be grouped together while game play requests initiated by relatively slow playing players may be separated out into a different game play group. This segregation of game play requests on the basis of how fast the initiating player plays reduces the risk that a player achieving a game ending pattern in a game will hold up play for the rest of the players in the game. For the game play group for relatively faster players, it is likely that the player achieving the game ending pattern will claim the result quickly, in essentially the same time that it takes other players to take the necessary result claiming action. On the other hand, for the game play group for relatively slower players, the slowness with which the game ending pattern winner may claim their result will not necessarily slow play for the other players in the game because the other players are relatively slow in claiming their results as well.

Although the invention is well suited for classifying or grouping players and their respective game play request by speed of play, the invention is by no means limited to classification based on this player characteristic. Rather, a "characteristic" that may be used to define a "play characteristic class" as used in this disclosure and the accompanying claims may be any characteristic associated with a player, for example, player age, betting level, gaming experience level, or even player-defined characteristics (that is, a player may be allowed to define or classify themselves as a "fast" or "slow" player). A "characteristic" used to define a "play characteristic class" according to the invention may also be a characteristic associated with a game play request or a series of game play requests and not necessarily with a given player.

A method according to the invention may also include defining different play characteristic classes for use in grouping game play requests. The definitions may be predetermined or may be dynamically determined based upon player characteristic information. This player characteristic information may be obtained externally from the gaming system or may be generated internally by monitoring player activity and game play in the gaming system.

A gaming system embodying the principles of the present invention includes a number of electronic player stations and at least one server in communication with each electronic player station. Each player station may be used by a player to produce or initiate a game play request for play in a bingo game. The server or servers collect the game play requests into the game play groups by play characteristic class and then conduct the games once sufficient game play requests have been collected. The server or elements associated with the server may also monitor game play or player characteristics such as the time it takes for a player to take the required result claiming action or actions after being prompted to do so (the result claiming action time), define play characteristic classes, and associate the various game play requests with the various classes. All of these functions may be performed on suitable processing equipment under the control of a suitable program product. A program product embodying the principles of the invention may include classification program code, group collecting program code and game engine or server program code. The classification program code is executed to make associations between game play requests and play characteristic classes, while the group collecting program code collects the game play requests into the various game play groups by play characteristic class. The game engine program code may then conduct the bingo games for the various collected game play groups.

DESCRIPTION OF PREFERRED EMBODIMENTS

The claims at the end of this application set out novel features which the Applicants believe are characteristic of the invention. The various advantages and features of the invention together with preferred modes of use of the invention will best be understood by reference to the following description of illustrative embodiments read in conjunction with the accompanying drawings.

The present invention may be used to classify and segregate game play requests or game players in many different types of bingo gaming systems. The following description of the present invention will be made in reference to a particular bingo gaming system disclosed fully in U.S. patent application Ser. No. 10/456,721 entitled "Method, System, and Program Product for Conducting Multiple Concurrent Bingo-Type Games," the entire content of which has been incorporated herein by reference above. However, it should be noted that the invention is not limited to any particular bingo gaming system. Rather, the invention may be used in connection with any bingo gaming system.

Figure 1:
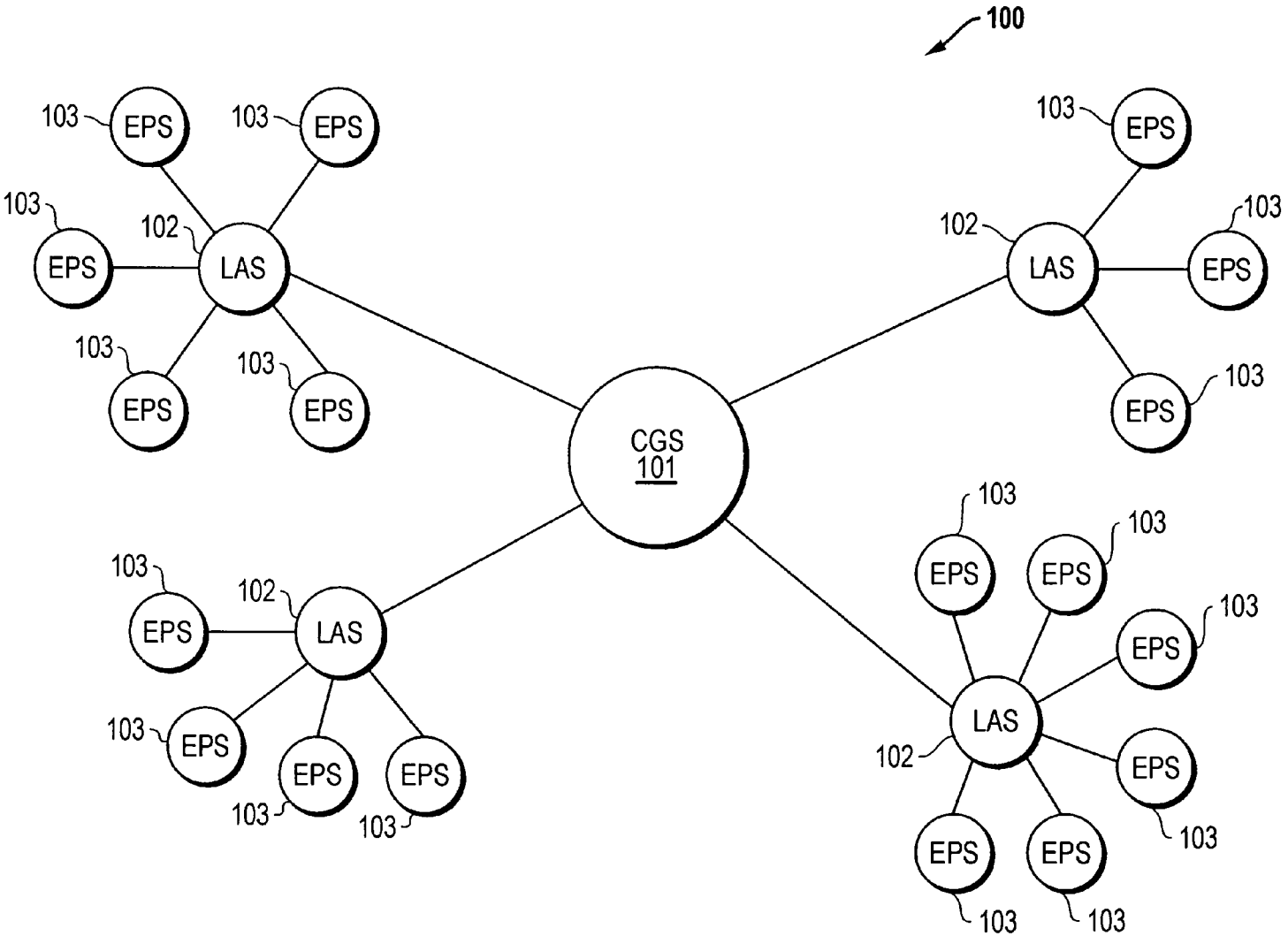
FIG. 1 is a high level diagrammatic representation of a bingo gaming system embodying the principles of the present invention.

FIG. 1 shows a gaming system 100 including a central game server (CGS) 101 that cooperates with a number of other components to enable bingo players, preferably at many different remote gaming sites, to participate in bingo games. Each gaming site includes a local area server (LAS) 102 and a number of electronic player stations (EPSs) 103. As will be discussed in detail below, in the normal operation of gaming system 100, a player at any EPS 103 in the system may participate in a given bingo game with players at any other EPSs 103 in the system. Thus, players at different gaming facilities may be grouped together for a given bingo game administered through system 100. Grouping together players from different gaming facilities for the play of a bingo game allows different bingo games to be played rapidly and minimizes the time that players must wait to receive the result of their participation in the bingo game.

The invention includes an arrangement for grouping players and/or game play requests for the play of a single bingo game to facilitate rapid play. This grouping includes limiting the number of players and/or game play requests included in a bingo game to reduce the time required to play the game. System 100 reduces the time between a game play request at one of the EPSs 103 and the return of results to the respective EPS sufficiently to allow a great deal of flexibility in how results in the bingo game are displayed to the player. In particular, the bingo game results may be displayed in some manner unrelated to bingo. For example, the bingo game results may be mapped to a display traditionally associated with a reel-type game (slot machine), to a display relating to a card game, or to a display showing a race such as a horse or dog race, for example. Preferred techniques for mapping bingo game results to displays associated with games or contests unrelated to bingo are described in U.S. patent application Ser. No. 10/060,643 filed Jan. 30, 2002, and entitled "Method, Apparatus, and Program Product for Presenting Results in a Bingo-Type Game." The entire content of this prior application is incorporated herein by this reference.

System 100 rapidly groups players and/or game play requests and starts one game after another so that multiple games may be in play at any given time. That is, once a first group of players or game play requests has been assigned to a bingo game offered through system 100, the system proceeds to simultaneously administer a bingo game for the first group of players or game play requests and also begins grouping players or game play requests for a next bingo game. System 100 does not necessarily wait for one bingo game to be completed before starting to collect players or game play requests for, and actually beginning play in, the next bingo game. The number of players or game play requests grouped for the play of bingo games according to the present invention may be limited to reduce the time required for grouping. For example, each bingo game offered through gaming system 100 shown in FIG. 1 may be limited to between 2 to 20 players or game play requests, with the preferred number for any given game being from 10 to 15. Where system 100 includes numerous EPSs 103 at the various remote locations, on the order of several thousand EPSs for example, hundreds of individual bingo games may be in process at any given time through the gaming system.

Regardless of the rapid play facilitated by system 100 and regardless of the manner in which the bingo game results are displayed, the underlying game remains a standard bingo game played in the traditional sequence of play for bingo games. That is, each player obtains or is assigned a bingo card or bingo card representation, all bingo cards in play in the game are daubed or checked for matches with a randomly generated sequence of designations (for example, designations produced in a ball draw or produced by a random number generator), and the first card in the game to match the sequence of designations to produce the game ending winning pattern wins the bingo game. Additional prizes may be awarded for other patterns that may be produced in the course of the bingo game. The mapping of different prizes to various bingo patterns that maybe produced in the course of a bingo game in system 100 maybe accomplished as described in U.S. Pat. No. 6,569,017 B2, entitled "Method for Assigning Prizes in Bingo-Type Games" or U.S. patent application Ser. No. 10/238,313, filed Sep. 10, 2002, entitled "Prize Assignment Method and Program Product for Bingo-Type Games." The entire content of each of these documents is incorporated herein by this reference.

Figure 2:
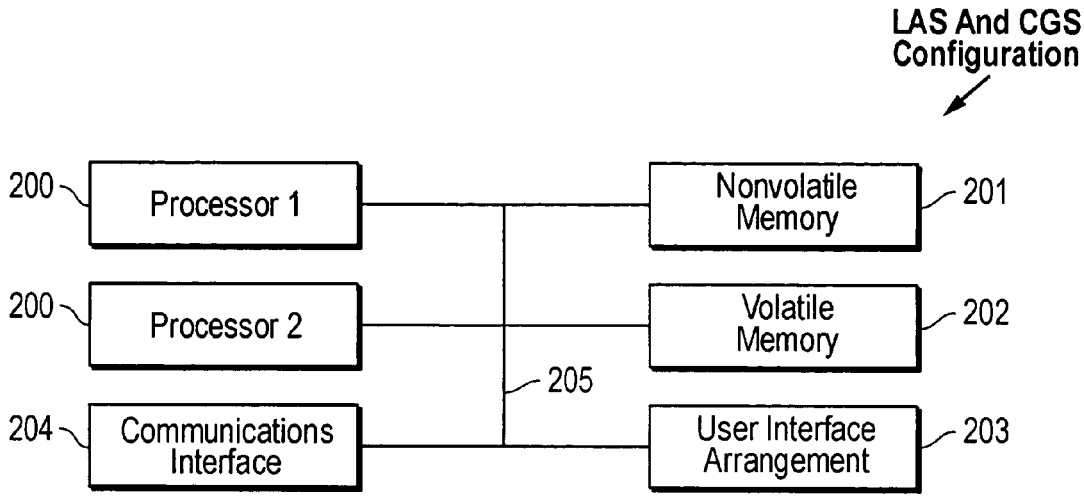
FIG. 2 is a diagrammatic representation of a computer system arrangement that may be used for the central game server and local area servers included in the system shown in FIG. 1.

CGS 101 may comprise a computer system such as the basic system shown in FIG. 2. The basic system may include one or more processors 200, nonvolatile memory 201, volatile memory 202, a user interface arrangement 203, and a communications interface 204, all connected to a system bus 205. It will be appreciated that user interface arrangement 203 may include a number of different devices such as a keyboard, a display, and a pointing device such as a mouse or trackball for example, although not shown in FIG. 2. Alternatively to the integrated user interface arrangement 203 shown in FIG. 2, a user interface for CGS 101 may be provided through a separate computer (not shown) in communication with the CGS. Regardless of the particular configuration for CGS 101, in the normal operation of system 100 shown in FIG. 1, the CGS functions to group players for participation in bingo games offered through the system, produces or obtains sequences of designations (ball draws, for example) for the play of the bingo games, checks for the results in the bingo games, and communicates the results to LASs 102. Specific processes performed by CGS 101 to provide these functions will be described below with reference to FIG. 6.

As used in this disclosure any sequence of designations that may be matched against bingo cards or card representations in the present gaming system will be referred to as a "ball draw" regardless of how the sequence is actually generated. Under this definition, it will be appreciated that a ball draw may be produced by a random number generator, a pseudo random number generator, or any other suitable device or system, and not necessarily a physical ball draw device.

Each LAS 102 included in system 100 as shown in FIG. 1 may comprise a computer system having the same basic structure as shown in FIG. 2. That is, each LAS 102 may include one or more processors 200, nonvolatile memory 201, volatile memory 202, user interface arrangement 203, and communications interface 204 all connected to system bus 205. As with CGS 101, the user interface for the respective LAS 102 may be provided through a separate computer and communications with the LAS rather than the integrated user interface arrangement 203 shown in FIG. 2. Regardless of the specific configuration of the LAS, each LAS serves, in normal operation of the system shown in FIG. 1, to transfer or relay information from its respective EPSs 103 to CGS 101 and transfer or relay information from the CGS to the LAS's respective EPSs. Each LAS according to the present invention may also have the ability to group players and actually play bingo games in certain situations. For example, where one LAS 102 serves a large number of EPSs 103, the LAS may group players or game play requests from its respective EPSs during a time of high player activity, obtain or produce a ball draw, determine results, and return results to the EPSs rather than having the CGS 101 perform these tasks. Also, each LAS 102 shown in FIG. 1 may be configured to perform the tasks normally performed by CGS 101 in the event the communications link between the respective LAS and CGS is degraded below a certain level or is severed altogether. Specific processes that may be performed by LASs 102 according to the invention will be described below with reference to FIGS. 5 and 7.

Figure 3:
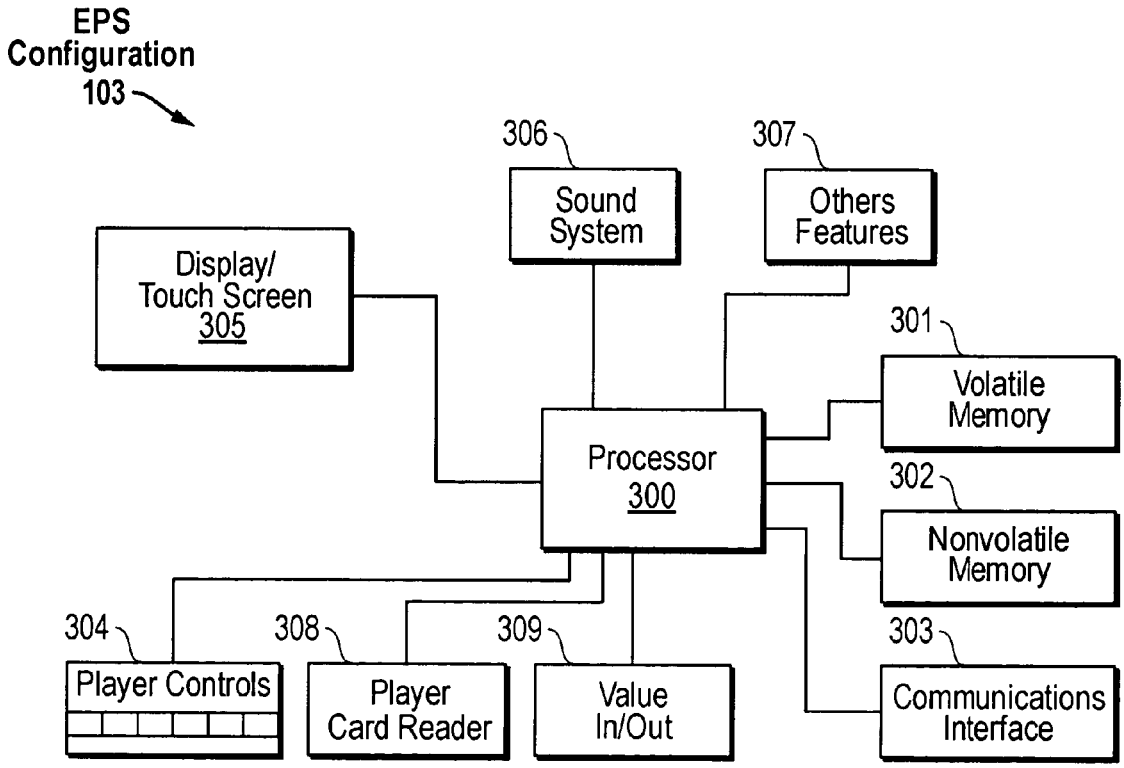
FIG. 3 is a diagrammatic representation of an electronic player station that may be used in the system shown in FIG. 1.

FIG. 3 shows an example of an EPS 103 that maybe used in a gaming system embodying the principles of the present invention. The illustrated EPS 103 includes a processor 300, volatile memory 301, nonvolatile memory 302, and a communications interface 303. The volatile and nonvolatile memory stores computer program code that may be executed by processor 300 to cause the processor to perform or direct the various functions provided by EPS 103. Communications interface 303 allows communications between EPS 103 and its respective LAS 102 and/or CGS 101. EPS 103 also includes a special user interface arrangement to facilitate player participation in the bingo games offered through gaining system 100 shown in FIG. 1, and displays results in an exciting and attractive format. This interface includes player controls 304, a display or touch screen display 305, a sound system 306, and perhaps other features 307 such as alarms or special displays or alerting devices. Each EPS 103 also preferably includes a convenient system for allowing the player to input player-specific information and for receiving wagers and dispensing winnings. For example, the EPS 103 shown in FIG. 3 includes a player card reader 308 that is adapted to read player-specific information from a player account card inserted into the reader. A player account card may, for example, include player information or simply a player identifier encoded on a magnetic medium (mag stripe) associated with the card, or encoded on bar code, or a memory device associated with the player card. The illustrated EPS 103 also includes a device 309 for receiving value and issuing value in the course of play. This device may accept currency, vouchers, or tokens, for example, and also output currency, vouchers, or tokens. Of course a separate device may be used to receive and issue value for games played according to the present invention. Alternatively or in addition to value in/out device 309, EPSs 103 may read player account information from the player card or player information otherwise input at the EPS, and account for wagers and winnings in the manner set out in U.S. patent application Ser. No. 10/044,478, filed Jan. 10, 2002, entitled "Distributed Account Based Gaming System," the entire content of which is incorporated herein by this reference.

It will be appreciated that the particular configuration of devices shown in FIG. 1 is shown only for purposes of example. A bingo gaming system according to the present invention may omit some or all of the separate LAS's 102 at the various gaming facilities so that the EPSs 103 communicate directly with CGS 101. Also, various regions or different gaming facilities may be divided up into separate systems each having a respective CGS such as CGS 101. In these situations the system could be configured such that a single EPS maybe serviced by any of the CGSs. Furthermore, a gaming system embodying the principles of the invention may include multiple CGSs rather than a single CGS 101 as shown in FIG. 1.

In the following description of FIG. 4 and the other process flow charts in this disclosure, it will be appreciated that the references to the physical components are references to the diagrams in FIGS. 1, 2, and 3 that show those components. The components, such as EPSs 103, LASs 102, and CGS 101 discussed with reference to the flow charts are generally not shown in the flow charts themselves but are shown particularly in FIG. 1.

Figure 4:
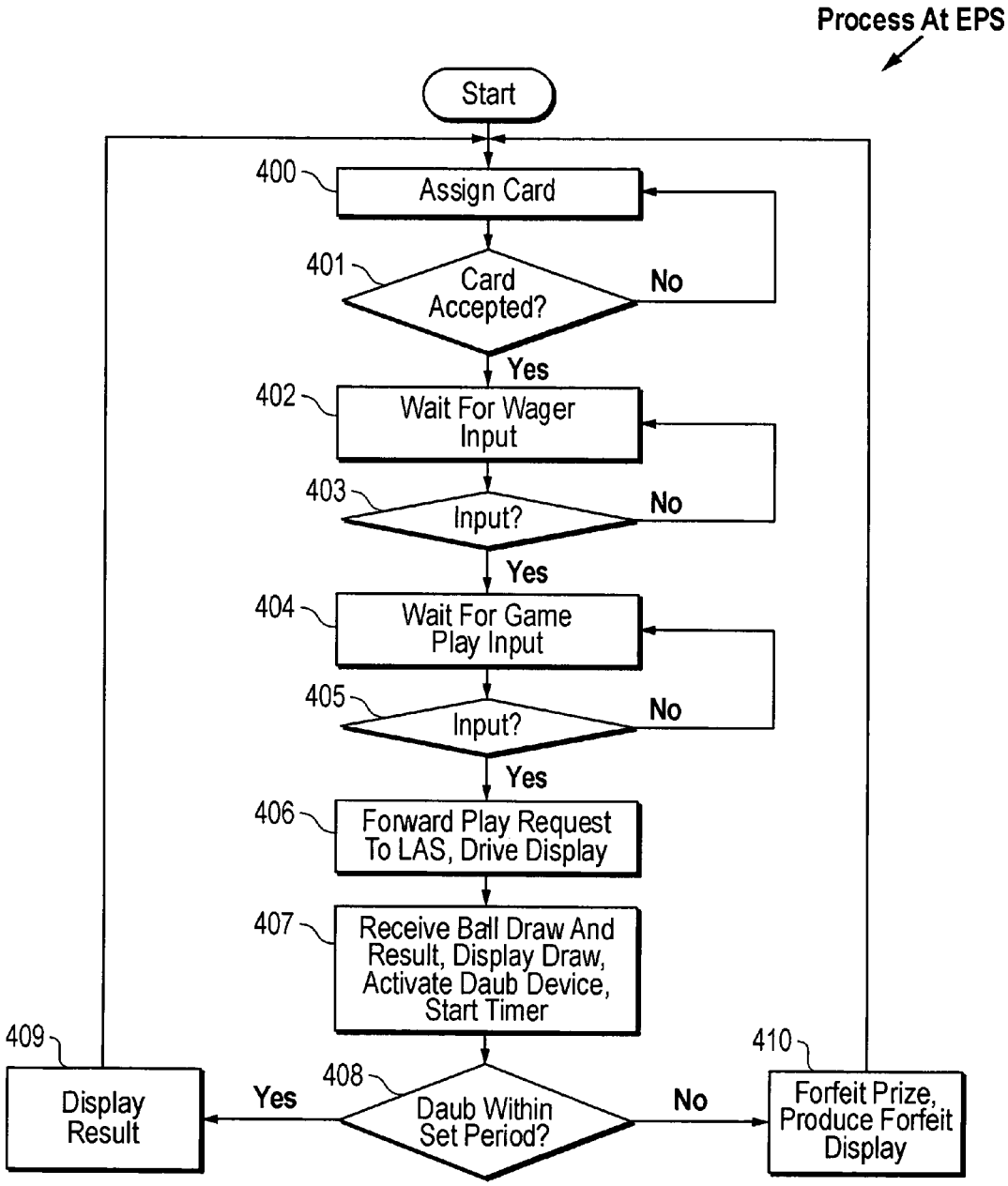
FIG. 4 is a flowchart providing a high level description of a process executed at the electronic player stations according to the present invention.

FIG. 4 shows a process that may be performed at an EPS 103 according to the invention. After EPS 103 is initialized and activated for use by a player, the process at the EPS includes assigning the player a bingo card as shown at block 400. In some forms of the invention, this card assignment process may be performed each time the player desires to make a game play request through EPS 103. In other forms of the invention the card assignment process need only be performed once and then the player may continue to use the same bingo card for numerous different game play requests, but with the ability to obtain a different card as desired. Regardless of whether the card assignment process is performed for each play or for multiple plays, the player may have the option to accept or reject a presented card as indicated at decision block 401. Alternate forms of the invention may not give the player a choice in accepting or rejecting a bingo card. On the other end of the spectrum, an EPS 103 according to the present invention may allow the player to build their own card or select cards from a number of available bingo cards.

Each card that is assigned to the player according to the invention is associated with a game play request, and comprises a representation of a bingo card that includes some arrangement of symbols or designations. The bingo system shown in FIG. 1 may be played with the standard 5-by-5 grid bingo cards, 3-by-3 grid bingo cards, cards comprising a single straight line of spots or card locations, or cards having some other arrangement of spots. Regardless of the nature of the bingo card played in the particular game, the card is represented by a data structure. An example of the structure will be described below with reference to FIG. 11.

It will be appreciated that the card assignment step shown at process block 400 in FIG. 4 may require communications between the respective EPS 103 and its respective LAS 102 or the CGS 101. In particular, in order for the results of a bingo game for a particular card to be determined at one of the LASs 102 or the CGS 101, the respective LAS or the CGS must have a definition of the card that indicates the symbol or designation associated with each spot on the card. Making the card definition for a particular bingo card available to the component in the system that determines the results of play for the particular bingo card may be handled in a variety of different ways within the scope of the present invention. In one preferred form of the invention, each EPS 103, each LAS 102, and the CGS 101 stores or has ready access to a bingo card definition file containing a large number of records each representing a particular bingo card and including a unique card identifier or index value. In this arrangement for storing card definitions, only the card identifier need be communicated between the system components in order for the system components to have a definition for the respective card. A system component having the card identifier for a particular card may simply look up the identifier in the card definition file and read the card definition associated with the identifier. For example, where a player selects a particular bingo card at an EPS 103, the EPS may communicate the card identifier to the respective LAS 102 or CGS 101, and the LAS or CGS may then use the card identifier to obtain the actual definition for the card, that is, the designations assigned to the various card spots.

Alternatively to including a card definition file at each of EPS 103, each LAS 102, and CGS 101, the various components may communicate the actual card definitions. Communicating the actual card definitions obviates a requirement for storing card definition files at the various system components but requires that more data be communicated between the various system components.

A card assignment process within the scope of the present invention may include additional actions or communications by the respective EPS 103 and the respective LAS 102 and/or CGS 101, depending upon the rules of play in the system. For example, the card assignment process may give the player at EPS 103 the option of defining his or her own bingo card or cards to place in play. In this situation, EPS 103 or some other component in the system may compare the card defined by the player to a predefined set of cards to locate an identifier for that particular card. Only the card identifier then needs to be communicated to the various components in the system to communicate the definition of the player's card assuming those components have access to a card definition table identifying each card representation by the assigned identifiers. Also, in situations in which players may define their own bingo card or cards, a system according to the present invention may include a process to ensure that two players do not have the same card in play in a particular game. This process may prompt the player to define a different card or may automatically return an even money result as discussed further below without actually entering the player in a bingo game.

In addition to the card assignment process indicated at blocks 400 and 401, the EPS process shown in FIG. 4 allows the player to enter a wager or card price for playing the card in a game offered through EPS 103. Process block 402 and decision block 403 indicate that EPS 103 waits for a wager input before proceeding on in the process. In preferred forms of the invention, the player may choose from a number of different wager levels or card price levels for each card the player places in play and these card price levels may be defined in terms of currency, credits, or in some other fashion.

Once the card is assigned to the player at EPS 103, and the price of the card or wager is defined, the card may be entered in a bingo game administered by the system 100 in which the respective EPS 103 is included. As indicated at process blocks 404 and 405 in FIG. 4, the EPS 103 may wait for a separate game play input or game play request entered by the player at the EPS, and only then proceed to forward the game play request to the other components of system 100. In other preferred forms of the invention, a separate input may not be required in order for the player to enter into a bingo game. For example, simply defining the wager may automatically enter the bingo card in a bingo game without any separate game play request, or, where the wager is predefined, the step of accepting a particular bingo card may enter the player in a bingo game. As yet another alternative, simply making a play request at an EPS 103 may define a bingo card for the player, define a wager level, and send a request to enter that bingo card in a bingo game administered through the system.

Once the player has, in one fashion or another, made an input at EPS 103 to enter their card or cards in a bingo game administered through the gaming system (100 in FIG. 1), the EPS forwards a game play request to the respective LAS 102 as indicated at process block 406 in FIG. 4, and preferably drives a display showing some type of entertaining graphics pending the return of the result for the player's card(s) in the bingo game. For example, EPS 103 may be configured to display results associated with the underlying bingo game in terms of reel stop positions for a reel-type gaming machine (slot machine). For this type of result display, the step of driving the display at process block 406 may include showing a number of reels spinning to imitate the spinning reels one would see immediately after activating a traditional reel-type gaming machine. Alternatively, results from the bingo game may be displayed in some other entertaining fashion such as a horse or dog race for example, and the step of driving the display shown at process block 406 in FIG. 4 may include an initial portion of the race. In yet other forms of the invention, results may be displayed as in a traditional bingo game and the step of driving the display shown at process block 406 in FIG. 4 may include simply displaying the bingo card that has been assigned the player and placed in play. Even where the results of the bingo game may be shown with entertaining graphics unrelated to the bingo game, a portion of the display at EPS 103 is preferably devoted to a representation of the bingo card in play and ball draw for the bingo game in which the card is entered.

The nature of the communication forwarding the play request to LAS 102 will depend upon a number of factors. For example, the communication may include an actual card definition for each card that defines the respective player's card which is in play for the game. Alternatively, where card definition files are available at the various system components as described above, the communication may include a card identifier for each card placed in play and this identifier may be used to locate the actual card definition. In still other forms of the invention, the player's card or cards placed in play from EPS 103 may have been known to the LAS or CGS from the card assignment process shown at process blocks 400 and 401. In this case, the game play request sent to LAS 102 at block 406 in FIG. 4 may not include even an identifier for the card(s) in play, but merely some signal for the LAS to place the card(s) in play for the requesting player.

Regardless of how EPS 103 drives the display at process block 406 in FIG. 4, the EPS receives a ball draw for the game in which the player has been entered and, for each card placed in play, a result for the game play which has been determined at the LAS 102 or CGS 101 as will be described in detail below. The receipt of the ball draw and result is shown at process block 407 in FIG. 4. The result received at EPS 103 represents the result of the respective player's card in the bingo game in which the player's card has been entered. As in any bingo game the result is associated with some pattern and/or sequence of spots on the player's bingo card that have been matched by designations in the ball draw. However, it will be appreciated that the result communicated to EPS 103 at process block 407 is preferably some result code that represents the actual bingo result. The ball draw and result may be sent to EPS 103 separately or in a single communication. In either case, the preferred form of the invention displays the ball draw on the display associated with the EPS prior to the time the respective game result is displayed.

In some preferred forms of the bingo gaming system, the bingo player must claim their bingo prize associated with a winning result. In systems in which the player must claim their prize, the EPS process may include activating a prize claiming or daub input at EPS 103 in the event a game play returns a winning result. This prize claiming or daub input activation is included at process block 407 in FIG. 4 along with the activation of a timer which sets a time period for the player to actuate the prize claiming or daub input and claim the prize. In a preferred form of the process at EPS 103, the EPS also produces a display indicating to the player that they must take a particular action to claim their prize, and indicating or counting down the time remaining to claim the prize. This timer or countdown display may be in addition to or in lieu of the display initiated at process block 406. A countdown timer display according to the invention may be superimposed on the display initiated at process block 406.

If the player claims their prize by taking the appropriate action within the set period of time as indicated by decision block 408 in FIG. 4, EPS 103 displays the result of the game for the player as indicated at process block 409, and gaming system awards the prize to the player. In the example described above in which the results may be displayed by reel-type or slot machine graphics, the display at EPS 103 may show reels stopped in particular positions that together correspond to the result achieved by the player in the bingo game. In the example where the results are shown by a horse or dog race, EPS 103 may show a particular horse or dog in a win, place, or show position corresponding to the result the player has achieved in the bingo game.

In the event the player at EPS 103 does not take the required action to claim the prize within the set period of time, the prize associated with the player's result in the bingo game may be forfeited as indicated at process block 410. In the case of a forfeited prize, EPS 103 may also produce a suitable display to indicate to the player that the prize associated with the play in the bingo game has been forfeited. Any forfeited prizes may be collected and applied to a progressive game offered through system 100 or may be collected for use as a charitable contribution. The forfeiture process may include subtracting a prize value from the player's account. This prize value may have been previously added to the player's account by system 100 automatically in response to the winning result.

Whether a prize has been forfeited as shown at process block 410 or has been claimed and the result displayed as shown at process block 409, the process at EPS 103 may return to card assignment steps 400 and 401 as shown in FIG. 4. As discussed above, it will be appreciated that the process may automatically assume that the player wishes to use the same card unless prompted for another card and/or may assume that the player wishes to make the same wager placed in the previous play. Thus, the process may return to a point in the process different from that shown in FIG. 4. A number of different options maybe provided to the player at EPS 103 to allow the player to choose a different card or cards to enter in another bingo game administered through system 100.

In some instances, the result from the bingo game may not be associated with any prize. In these instances, the process at EPS 103 may not activate a daub or prize claiming input device, and not wait for an input before displaying the result. Rather, the process at EPS 103 may simply include displaying the non-winning result immediately after receiving the result from LAS 102 without further intervention on the part of the player.

It will be noted from FIG. 4 that participation in a bingo game offered through an EPS 103 can be thought of as a three-step process aside from any login step that may be required at the EPS. The first step includes the card assignment process and the buy-in or wager amount selection process as indicated at process blocks 400 through 403 in FIG. 4. In the second step, the player puts the card in play as indicated at process blocks 404 and 405 in FIG. 4. In the third step required to participate in a game, the player daubs the card once the bingo numbers have been drawn. This last participation step is indicated by the decision block 408 in FIG. 4. The course taken from decision block 408 turns upon whether the prize claiming or daub input has been entered by the player.

Although the process shown in FIG. 4 may be thought of as a three-step process, there are many variations in the participation steps within the scope of the invention. In one particular embodiment, the player must not only make a daub input within some set period of time, but must also take some additional action, that is, operate some control at the player station, in order to claim a result. In this variation, the process would not branch to display the result as shown at process block 409. Rather, the process would proceed to the step of activating a result claiming timer in response to an affirmative result at decision block 408. After activating the timer, the process would include a decision block similar to block 408 in FIG. 4 to determine if the required result claiming action had been taken within the set time. If the result claiming action is taken within the set time, the result is displayed to the player similarly to the step shown at block 409 in FIG. 4. Otherwise, the result may be forfeited similarly to the step indicated at block 410 in FIG. 4.

Considering that there may be great variation in the player actions required to claim a result in a bingo game conducted according to the invention, the action or actions required will simply be referred to in the remainder of this disclosure and the accompanying claims as a "result claiming action." For example, where the player need only operate some control once to claim their result, the operation of the control would be referred to as a result claiming action. As another example, where the player must operate multiple controls or operate the same control multiple times, all of this activity would also constitute a result claiming action.

In some forms of the invention, the player's failure to enter a prize claiming or daub input may not result in the forfeiture of the prize, but rather cause the underlying bingo game to proceed with the ball draw (or additional numbers in the already defined ball draw sequence). In these forms of the invention, a player's failure to claim the game ending prize causes the underlying bingo game to continue with additional bingo numbers until another game ending winner is produced. This new game ending winner may then be given the opportunity to claim the game ending prize. If the player fails to take the result claiming action at this point, the result may be forfeited or the game may proceed again until another new apparent game ending winner is identified.

In yet other forms of the invention, the EPS 103 may force the player to take a result claiming action in order to proceed on to another game. Also, the result claiming action may be defined broadly so as to ensure that a player takes the action to claim their result. For example, where a player card must be inserted into an EPS 103 in order for a player to participate in a bingo game offered through system 100, the act of removing the player card may be defined as the result claiming action if the EPS 103 is waiting for such an action from the player.

Figure 5:
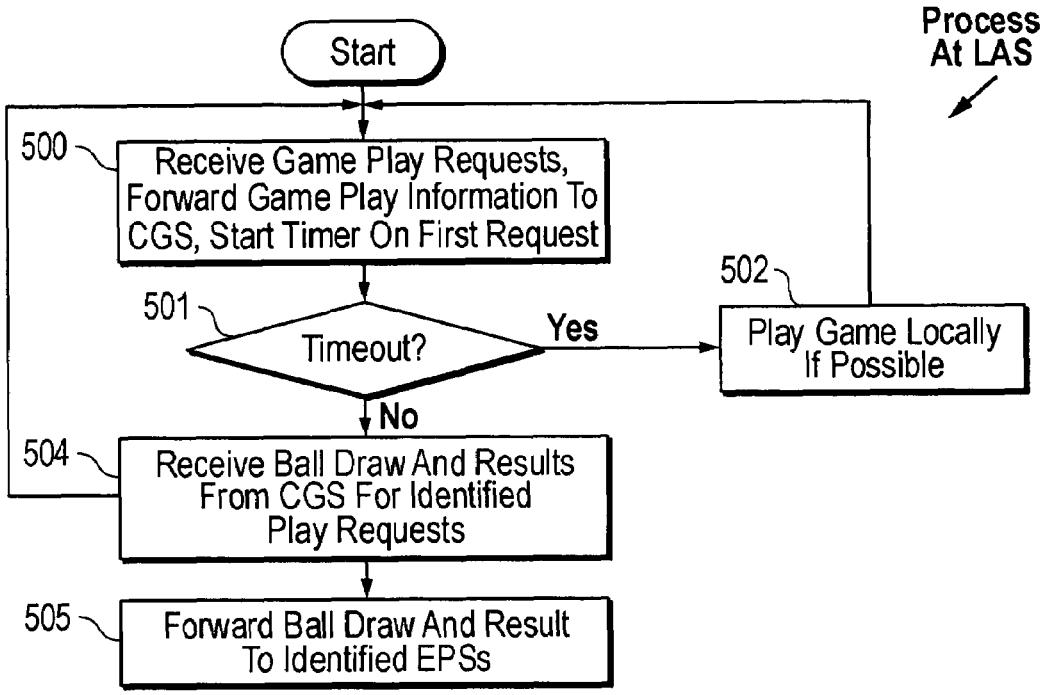
FIG. 5 is a flowchart providing a high level description of a process executed at the local area servers according to the present invention.
Figure 6:
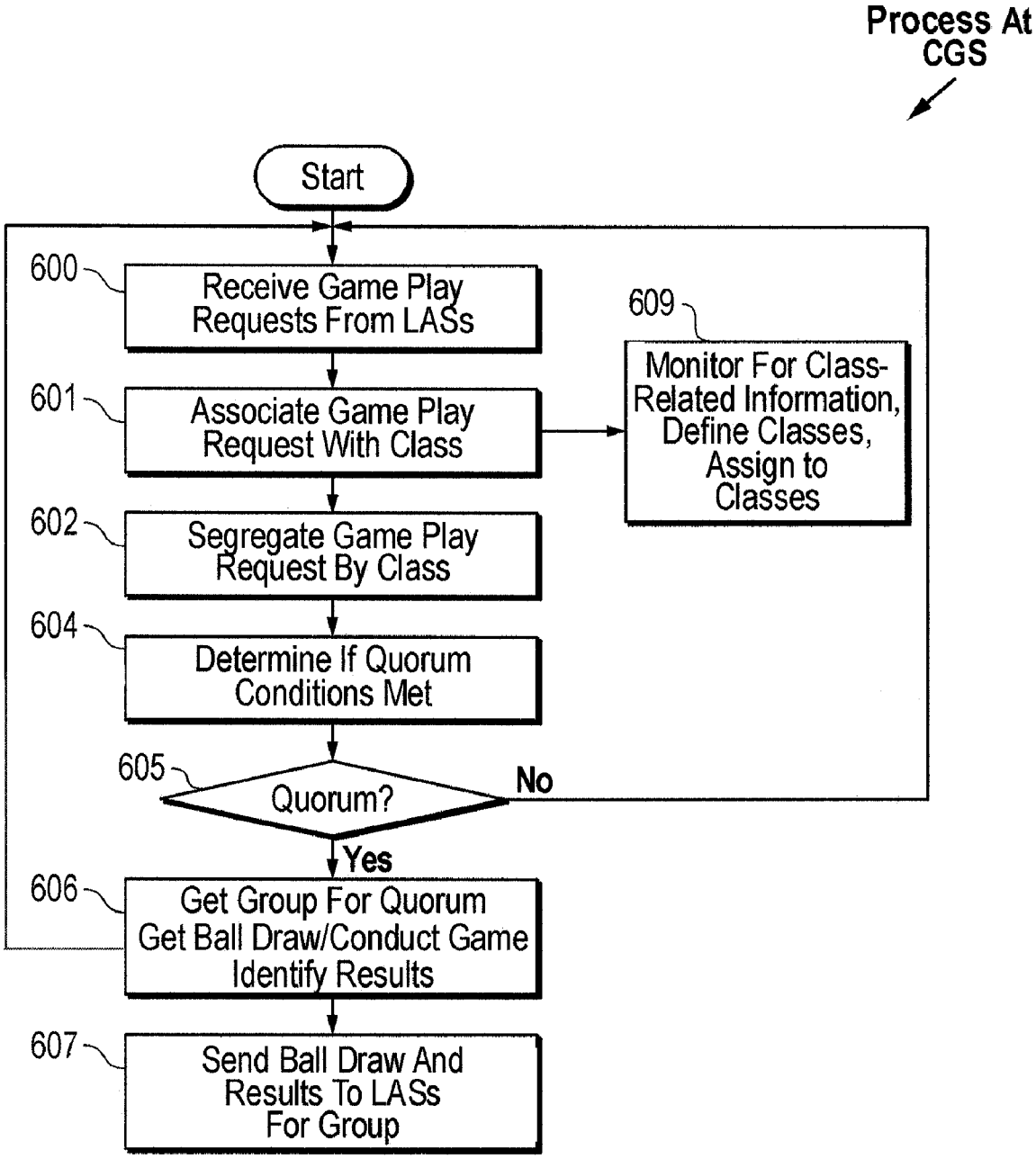
FIG. 6 is a flowchart providing a high level description of a process executed at the central game server according to the present invention.

FIGS. 5 and 6 may be used to describe one preferred arrangement for cooperation between the LASs 102 and the CGS 101 in system 100 shown in FIG. 1, and to describe the processes performed at the LASs 102 and CGS 101 in that arrangement. In this particular arrangement for cooperation between LASs 102 and CGS 101, the CGS always groups players or game play requests for each game available through the system. The group of players or game play requests for a game administered through system 100 will be referred to in this disclosure as a quorum and will comprise some minimum number of players that may be a fixed number, a range of numbers, or a number determined dynamically depending upon certain system operating parameters and/or the nature of the game play requests.

Referring now to FIG. 5, each LAS 102 receives a game play request from one of the EPSs 103 serviced by respective LAS and immediately forwards the game play request to CGS 101 along with information associated with the request such as a card definition or card identifier from which the card definition may be determined. This receiving and forwarding step is shown at process block 500. As indicated at block 500, the LAS process may also include starting a timer on the receipt of the first game play request from a local EPS 103 for a given game. If a timer set at process block 500 times out before CGS 101 returns a ball draw and results for the game play requests which have been collected and forwarded to the CGS as indicated at decision block 501, LAS 102 may attempt to play the game locally if possible as indicated at process block 502. A timeout may occur if the communications link has been broken with CGS 101, or if the communications link has been degraded in some fashion. In this case it is necessary for LAS 102 to attempt to play games with only local players. Of course, if quorums cannot be produced locally with sufficient speed, LAS 102 may simply notify the EPSs 103 that new games are not presently available, or if the situation is transient, return even money results to the requesting players as discussed further below.

In situations where no timer is used at LAS 102 or a timeout has not occurred at decision block 501, the LAS receives a ball draw for the game play requests it has forwarded to CGS 101 along with the results of the game for those play requests/players. The actual communications between LAS 102 and CGS 101 may require that the ball draw is sent in one communication and the results are sent as a separate communication or communications, otherwise both the ball draw information and results for the game may be sent as a single communication. At process block 504, LAS 102 receives the ball draw and results for the collected number of game play requests that were forwarded to CGS 101. The process at LAS 102 then proceeds to forward the received ball draw to the EPSs 103 from which the collected game play requests originated, as shown at process block 505. LAS 102 also forwards the results for the various game play requests, that is, the game results, to the respective EPSs 103. It will be noted that once a ball draw and results have been received for one group of game play requests that have been forwarded to CGS 101, the process returns back to process block 500 and continues to receive and forward game play requests for another bingo game as indicated by the line returning from block 504 to a point in the process immediately below the starting point.

FIG. 6 shows a process at CGS 101 that may be used in connection with the LAS process shown in FIG. 5. The process for CGS 101 includes receiving play requests from the various LASs 102 as shown at process block 600 in FIG. 6. The process also includes associating the received game play requests with a respective play characteristic class as shown at process block 601, and then segregating the game play requests into different game play groups according to class as shown at process block 602. The different game play groups for the different play characteristic classes are collected simultaneously until CGS 101 determines if predetermined quorum conditions have been met for a respective game group as shown at process block 604. Preferred alternatives for this quorum determining step will be described below with reference to FIG. 7. As shown at process block 605, if it is determined that conditions for a quorum have not been met for any of the different game play groups, the process returns back to process block 600 to receive further game play requests from LASs 102. However, if conditions for a quorum have been met for one of the segregated game play groups as indicated at decision block 605, CGS 101 obtains or produces a ball draw for the game and identifies the results associated with the game by comparing the ball draw with the bingo cards associated with the game play requests which make up the quorum. These functions are shown at process block 606 in FIG. 6. In addition to the other steps set out at process block 606, the process returns back to process block 600 to continue receiving game play requests from the LASs for other bingo games. As shown at process block 607 in FIG. 6, CGS 101 also communicates the ball draw and results for a given game to the LASs 102 implicated for the particular game play group for which a game has been played or initiated and results obtained.

The discussion above regarding FIG. 6 assumes that it is the CGS 101 that groups players and conducts bingo games in system 100. However, it will be appreciated from U.S. patent application Ser. No. 10/456,721 that alternative arrangements may allow the LASs 102 to group players and conduct games in certain circumstances. In these alternative arrangements, the steps of associating game play requests with the various play characteristic classes as shown at process block 601 in FIG. 6 and the step of segregating the game play requests by play characteristic class as shown at process block 602 in that figure will be performed by the respective LAS 102 grouping the game play requests and conducting the game.

The segregation step shown at process block 602 in FIG. 6 may be performed in any suitable manner at CGS 101. In one preferred implementation, group collecting program code executed at CGS 101 may segregate incoming game play requests, or data representing the incoming game play requests into different queues, each queue dedicated to a respective play characteristic class. Alternatively, game play requests or data representing the requests may be directed to a single queue or set of memory locations and the various entries marked as belonging to one play characteristic class or another. The invention is not limited to any particular arrangement for segregating the game play requests by play characteristic class, provided the game play requests are collected or held in some fashion that allows games to be played with the game play requests on a class by class basis.

The association step shown at process block 601 in FIG. 6 may be performed in a number of different ways pursuant to the present invention. In one embodiment, the association step includes using information from the game play request or associated with the game play request to perform a look up in a look up table that correlates game play requests with one of the classes used in the system. For example, the game play request may include or be accompanied by a player identifier and the player identifier is correlated to a class in the lookup table. As another example, a game play request may include or be accompanied by a play session identifier and this play session identifier may be correlated to a class in the lookup table. The player identifier arrangement may be useful in gaming systems in which the players are identified in some fashion either for accounting purposes or otherwise, while the session identifier arrangement may be useful in gaming systems in which the players are anonymous, but play is tracked on a session basis at a respective EPS 103. The player identifier and session identifier simply represent an identity for the game play request by which a desired class association may be made at an element external to the EPS such as CGS 101.

An alternative process for associating a game play request with a play characteristic class according to the present invention is performed at the production of the game play request. In this alternate process a given EPS 103 is identified as producing game play requests that are to be associated with a given play characteristic class. Once the EPS 103 is identified (because of a particular player using the EPS, because of a history of play at the EPS, or otherwise) CGS 101 may communicate an instruction to the respective EPS 103 to include some identifier for a given play characteristic class to each game play request initiated from that EPS. In this case, the association between the game play request and the play characteristic class occurs at the time the game play request is created and before it is even received at CGS 101.

The association of a game play request and a play characteristic class may be based upon information provided to the element in the system that performs the association or upon information obtained or collected by the gaming system. For example, in the lookup table association step described above, the lookup table may be provided by some element external to gaming system 100. Alternatively, the element that performs the association, in the illustrated example CGS 101, may also include the capability of obtaining information upon which play characteristic classes may be based, defining play characteristic classes, and populating the defined classes, or any of these functions individually. These process steps are shown in FIG. 6 at process block 609. For example, play monitoring software executed at CGS 101 may monitor game play in gaming system 100 to obtain information that may be used in classifying game play requests. One particular type of monitoring might be for the result claiming time for various players in the system or at various EPSs 103 in the system. In this example, class definition software may use this information to define three different play characteristic classes, a first class in which the result claiming action has historically been done in less than a second, a second class in which the action has historically been done between 1 and 3 seconds, and a third class where the action is historically taken in over 3 seconds. Based upon these defined classes, CGS 101 may populate the three classes with player identifiers, session identifiers, or EPS 103 identifiers depending upon which of these or some other identifier is used to make the association of a play characteristic class with a game play request.

Although the result claiming action time is used in the preceding paragraph as an example of information on which play characteristic class may be based, the invention is by no means limited to this type of information. Also, even within this type of information, the information may be defined in a number of different ways. For example, result claiming action time might be measured from the time a player is prompted to take an action to the time the action is taken, or may be measured from the time the player enters a game play request to the time the result claiming action is taken, or might be measured in yet some other way.

It should also be noted that the population of play characteristic class need not be limited to a particular metric. For example, where play characteristic classes are based on result claiming action time, a player (or the player's game play requests) may be assigned initially to a given class based on information other than historical result claiming action time for that player. The initial classification, may be based on the player's age, type of EPS 103 used by the player, or the player's own input indicating that they want to be classified in one or the other of the play characteristic classes, for example. Of course, should the player turn out to be inappropriate for a given classification, such as where they are consistently faster or slower than is appropriate for the initially assigned class based on result claiming action time, the system according to the invention may switch the player to a more appropriate classification so that the player's further game play requests will be associated with a different play characteristic class. The player may or may not be notified of the switch in the way their game play requests are initiated.

Figure 7:
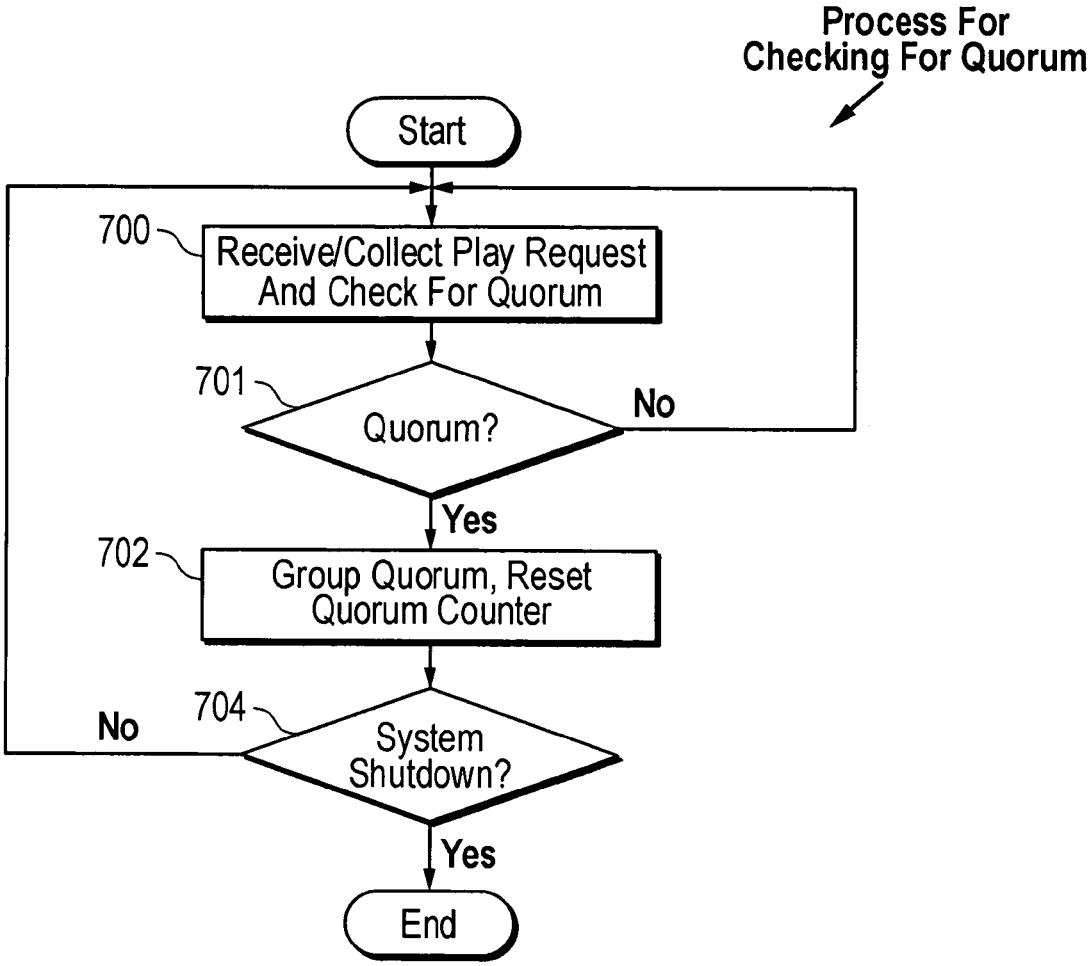
FIG. 7 is a flowchart showing a process for defining a set of players for a game in a bingo gaming system according to the present invention.

FIG. 7 shows one preferred process for checking for a quorum of game play requests that may be used in a gaming system according to the present invention. The quorum checking process includes receiving or collecting a game play request and then immediately checking for a quorum as indicated at process block 700. In one preferred arrangement for implementing the process shown in FIG. 7, each received game play request (or data representing the game play request) is stored in a first in/first out queue. Checking for a quorum in this implementation includes checking to see if all or a desired number of queue locations have been allocated, that is, store valid data for a received game play request. Instead of checking to see if the desired number of queue locations have been allocated, the quorum checking process may maintain a counter that provides a value indicating the number of received game play requests that are available for grouping for a bingo game according to the present invention. In this implementation, checking for a quorum includes comparing the number of game play requests indicated by the counter to see if that number is greater than or equal to some desired minimum number for a bingo game.

Regardless of how the system checks for a quorum of collected game play requests, if a quorum is not available as indicated at decision block 701, the process returns to wait for the next game play request received. However, if it is determined that a quorum is available at decision block 701, the process proceeds on to process block 702 at which the quorum is formed, that is, a group of game play requests are identified for a particular bingo game according to the invention. The process at block 702 may include reading the data from the queue locations for the game play requests in the group or quorum and deallocating those queue locations to make them available for additional game play request data. Where a counter is used to track the number of received game play requests, the process at block 702 may include clearing or resetting the counter to start counting game play requests for the next quorum/bingo game. After process block 702, the process returns to wait for additional game play requests or ends if the system is being shut down as indicated at decision block 704.

The process shown in FIG. 7 or any other suitable process for determining if quorum conditions have been met may be employed by the by CGS 101 at process block 604 in FIG. 6, or by any other element in the system responsible for checking for a quorum. Also, it should be noted that the conditions of a quorum may be modified dynamically according to conditions in the gaming system and/or according to the nature of the game play requests that have been received for a given play characteristic class. For example, during times of heavy activity in gaming system 100 shown in FIG. 1, the conditions for establishing a quorum may be dynamically increased to some optimum level. On the other hand, in times of low system utilization or where the LASs 102 attempt to create local quorums, the conditions for a quorum, for example the number of players/game play requests required for a quorum, may be decreased to some minimum level. The decrease in the number of game play requests needed to make a quorum for a given play characteristic class may take into account the payouts available in the bingo game and the permissible delay between the time a player makes a game play request and the time that results are available to be displayed to the player in response to a game play request. In any event, decreasing the number of game play requests needed for a quorum to play a bingo game through system 100 in FIG. 1 may have the effect of reducing the time required to produce a quorum and thus reduce the maximum delay between the time the player makes a game play request, that is, puts his or her card in play, and the time they receive the result of the bingo game at the EPS 103.

It should further be noted that the number of game play requests grouped together in a given play characteristic class for a bingo game according to the invention need not be a static number at any given time. Although the system may be configured to simply group a fixed number of game play requests when a quorum is achieved under the applicable quorum rules, some forms of the invention may be configured to group more or fewer game play requests depending upon other factors. For example, in the quorum checking process shown in FIG. 7, the process of checking for a quorum will take some time even in a high speed processing system. During this time, the component which is performing the quorum check may receive one or more additional game play requests for the play characteristic class for which a quorum is being checked. To handle these additional game play requests, the system may employ one or more buffers to hold game play requests for the given play characteristic class received during the quorum checking process. If the check detects a quorum for the play of a bingo game, the grouping process may take not only the collected game play requests for the given class but also any game play requests that have been stored in the buffer for the given class during the quorum checking procedure. Also, where the check for a quorum of collected game play requests indicates there is only a small number of requests below a desired minimum, and the number of received game play requests has remained static for a certain period of time, the system may be configured to declare a quorum with only the received number of game play requests even though it may be below the desired number for a quorum.

In operation of the present bingo gaming system, there may be situations in which a quorum suitable for playing a bingo game for a given play characteristic class is not obtained in a reasonable time. In this case, the gaming system according to the invention may check to see if another game play group being collected for a different play characteristic class is near the applicable quorum level and transfer one or more of the game play requests from the game play group for the given play characteristic class to the other game play group. This process of transferring game play requests from one game play group to another may allow an overall increase in the rate at which quorums are produced, although it does have the effect of ignoring the play characteristic classes that have been defined for and associated with the game play requests. It should also be noted that the process of transferring game play requests from one game play group for a given play characteristic class to another game play group may include transferring all of the game play requests for the one group to a single other game play group or transferring some game play requests to two or more different game play groups.

Where the system simply cannot produce a quorum of game play requests in a reasonable time, game play requests may be returned. This return process is described in detail in U.S. patent application Ser. No. 10/456,721, incorporated herein, and will not be repeated here.

Many of the process steps described in FIGS. 4-7 are preferably performed by processing devices, such as those described in FIGS. 1-3, under the control of operational program code. For example, classification program code can be executed to associate game play requests with the various play characteristic classes, and group collecting program code can be executed to collect groups of game play requests according to class at the element in the system responsible for that task. Quorum checking program code can be used to implement process block 604 to determine if a given game play group meets the predefined conditions for a quorum. If the conditions for a quorum are met, then game program code conducts a bingo-type game with the given game play group of game play requests as described in relation to process block 606.

In some implementations of the invention, player characteristic monitoring code may be executed to monitor player activity in the gaming system to obtain information that may be used to define play characteristic classes and assign players or game play requests to those classes. Class definition program code may be executed to analyze the collected information and define various play characteristic classes, and class assignment program code may be executed to assign players, game play requests, or EPS's to the various play characteristic classes. Other program code employed in system 100 is described in U.S. patent application Ser. No. 10/456,721 and will not be repeated here.

Figure 8:
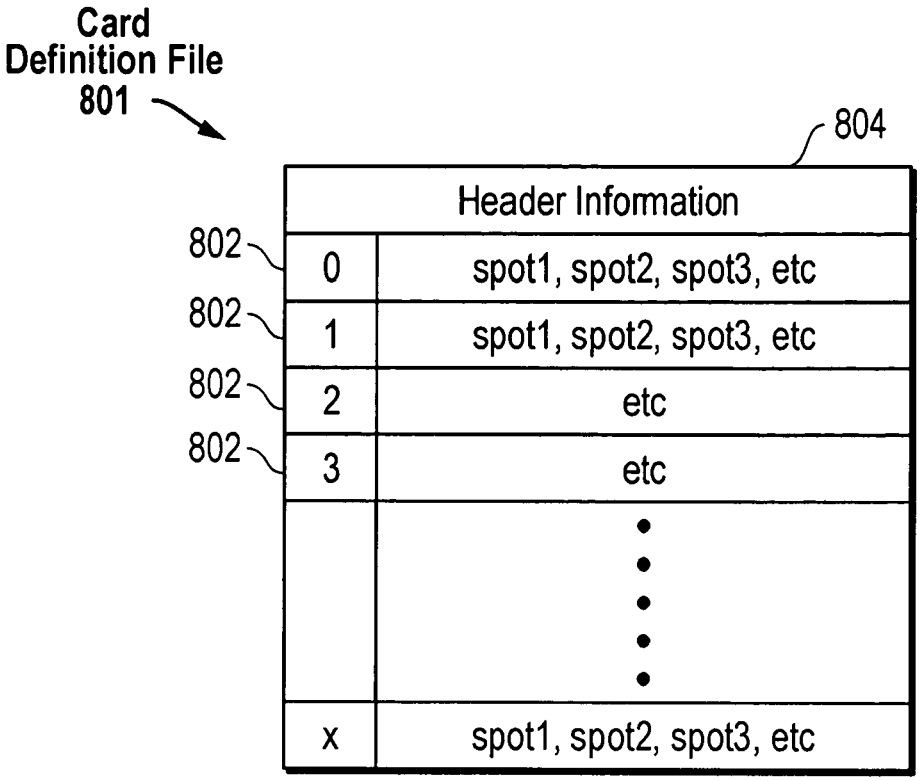
FIG. 8 is a diagrammatic representation of a bingo card definition file that may be used in a bingo gaming system according to the present invention.
Figure 9:
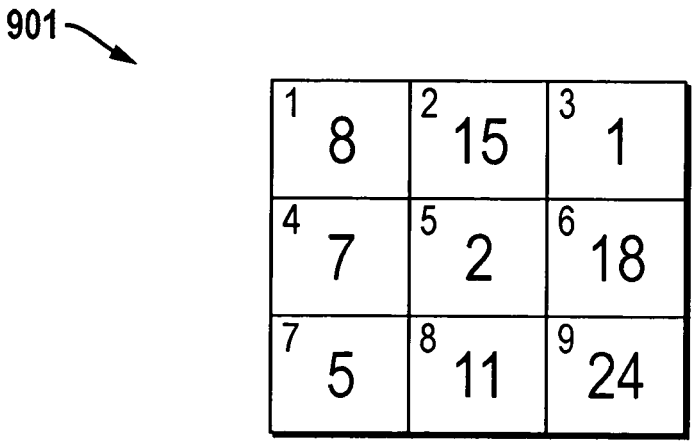
FIG. 9 is a diagrammatic representation of a bingo card face that may be employed in bingo games played in the present invention.

FIG. 8 shows an example data structure for defining bingo game card faces for use in the gaming system shown in FIG. 1. The data structure represents a file or card definition file 801 that includes a number of records 802, labeled record 0 through record X in the figure. The file may contain a very large number of card definitions, for example, three hundred thousand or more records 802. Card definition file 801 will generally also include header information 804 that may include identifying information for the file and other data related to the card definition file. The first designation in each record (the designation in the leftmost column in FIG. 8) represents a card identifier or index that identifies the card face defined by the remainder of the record. The remainder of the record includes a list of designations representing the designations at the various spots on the card face. Using the example 3 by 3 bingo card face 901 shown in FIG. 9 for the first card definition record 802 in file 801, the record would read 0, 8, 15, 1, 7, 2, 18, 5, 11, 24. In this structure, the 0 represents the card identifier or index, the designation "8" represents the designation in spot 1 of card 901, the designation "15" represents the designation in spot 2 of card 901, the designation "1" represents the designation in spot 3 in card 901, and so forth for the remainder of the nine spots included in the card face. It will be noted from FIG. 9 that the spot identifiers are shown as numeric elements in the upper left corner of each spot in the 3 by 3 grid and the larger print number in the middle of each spot represents the bingo designation associated with that spot.

It will be appreciated that the invention may use card definition data structures different from those shown for purposes of example in FIG. 8. For example, the identifier may be located at any location within the data structure and the spots may not be in the order indicated in FIG. 8.

Figure 10:
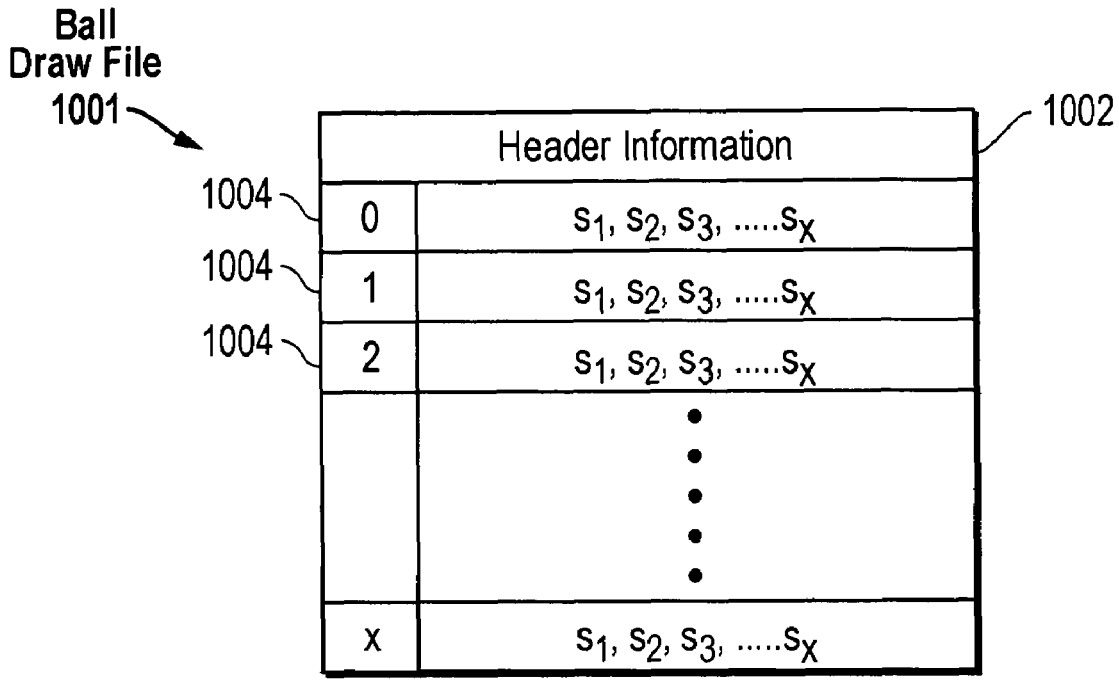
FIG. 10 is a diagrammatic representation of a ball draw file that may be used in certain versions of bingo gaming systems according to the present invention.

FIG. 10 shows an example of a data structure that may be used to store a number of ball draws for use in the present bingo gaming system. The data structure comprises a ball draw file 1001 that may include header information 1002 with identifying data and other data regarding the file. The ball draw file 1001 also includes a number of records 1004 labeled record "0" through "x" in the figure. The leftmost value or entry in each illustrated record 1004 represents an identifier or index for the particular record. For example, the value "0" comprises the identifier for the first entry 1004 in ball draw file 1001. The remainder of each record includes a series of designations corresponding to or representing the bingo designations generated in a ball draw device or random symbol generator. The symbols $S_1$, $S_2$, $S_3$ through $S_x$ shown in FIG. 10 represent the designations making up the particular ball draw in the sequence they were drawn or generated. That is, $S_1$ represents the first ball drawn in the ball draw, $S_2$ represents the second ball drawn in the ball draw, and so forth. The number of designations needed for each ball draw will depend upon a number of factors known in the design of traditional bingo games.

Figure 11:
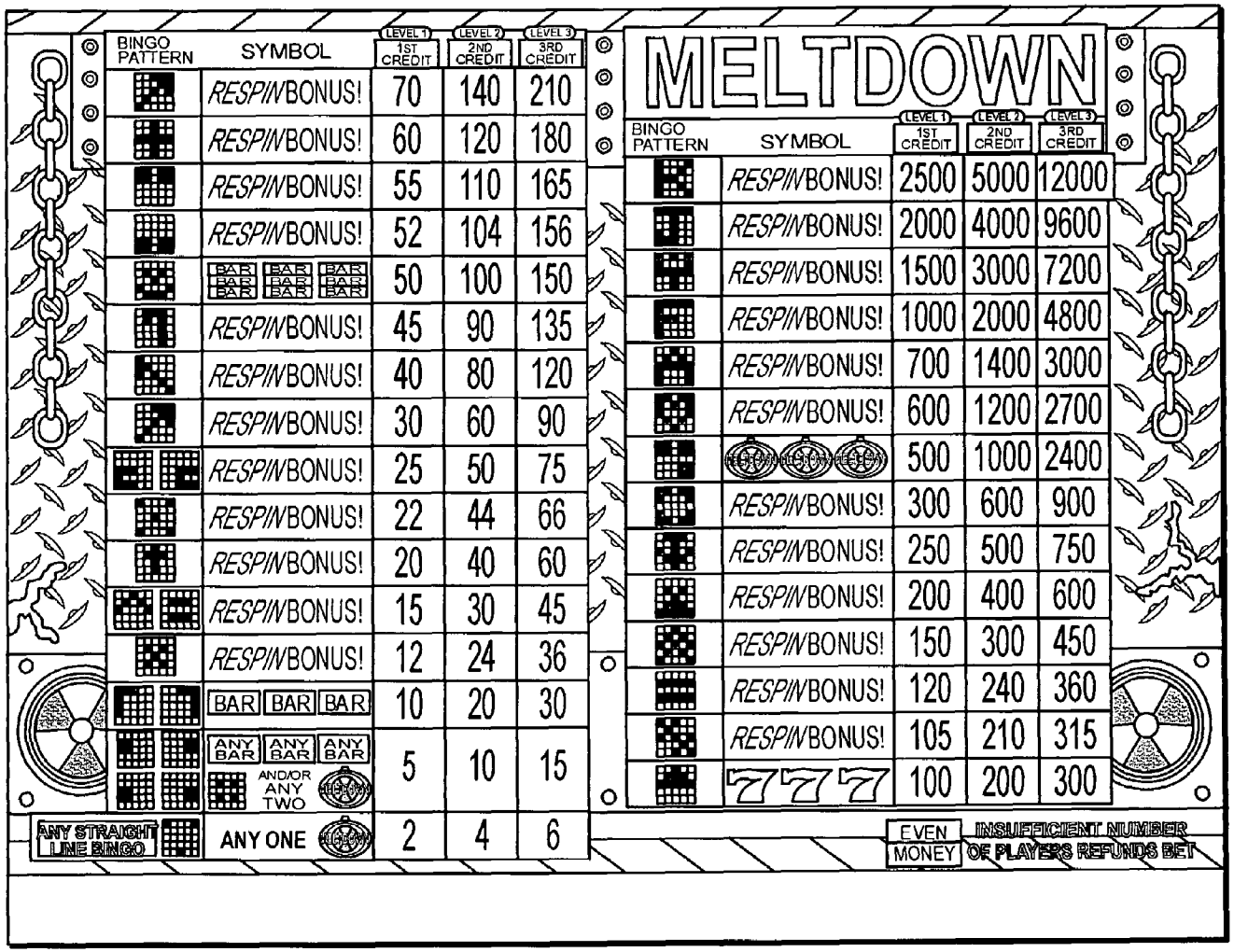
FIG. 11 is a representation of a payout table that may be used for a bingo game played through the gaming system shown in FIG. 1.
Figure 12:
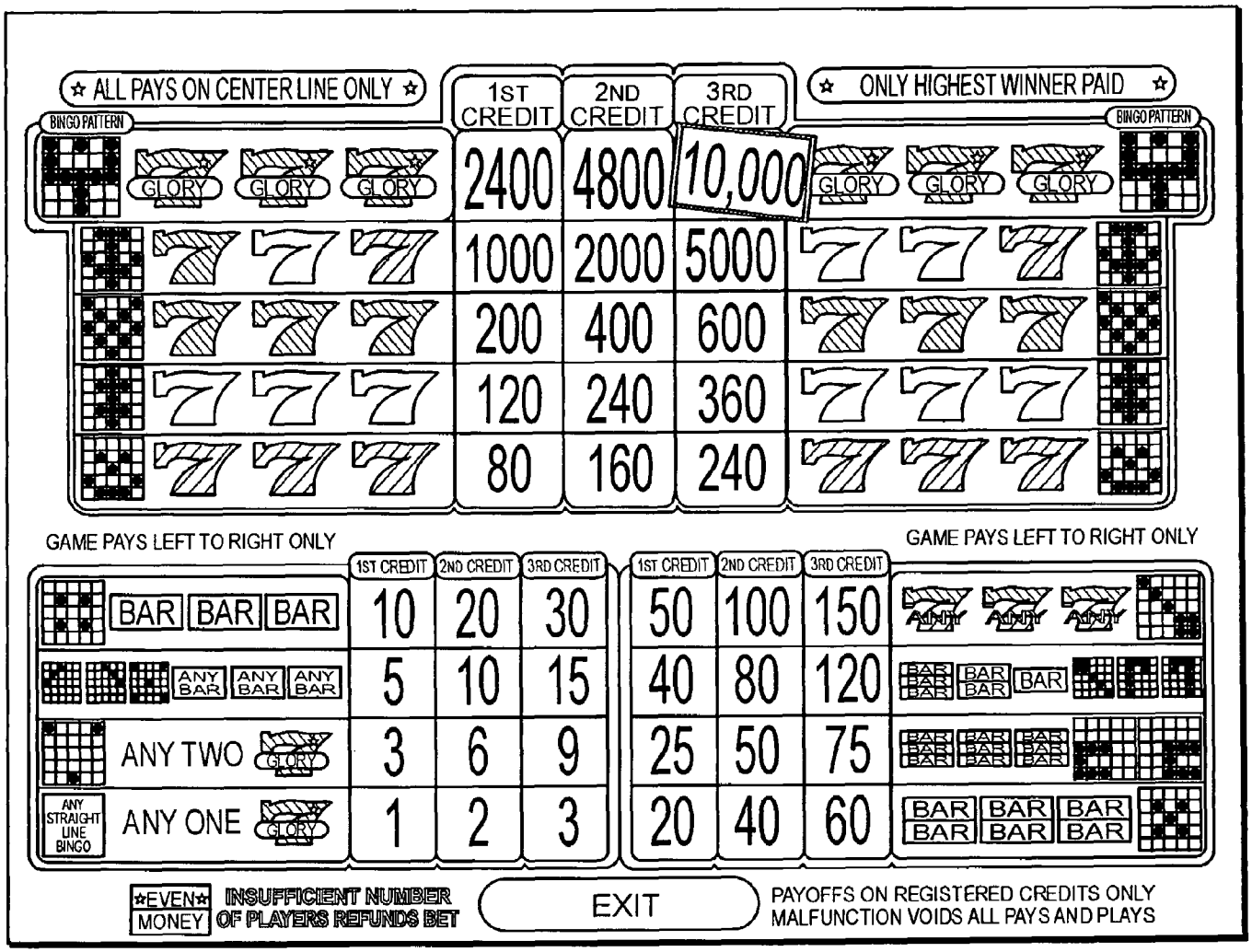
FIG. 12 is a representation of an additional payout table that may be used for a bingo game played through the gaming system shown in FIG. 1.

FIGS. 11 and 12 show examples of payout tables that may be used in displaying results of bingo games administered through the present gaming system. These payout tables are each associated with a specific type of reel-type game display or presentation. It will be noted that each prize level is associated with one or more bingo patterns that are each mapped or associated to that prize level. The payout table also shows the reel stop positions that are associated with each prize level/bingo pattern set. That is, if participating in the system 100 through an EPS 103 implementing the illustrated game presentations, achieving a particular bingo pattern in the gaming system will be shown on the EPS by a reel stop arrangement corresponding to the particular bingo pattern. This reel-type display is preferably in addition to an actual bingo card display also shown at the EPS 103 either simultaneously or otherwise.

It will be noted that the various EPSs 103 included in gaming system 100 shown in FIG. 1 may each be adapted for a particular display or presentation, and that the system may host many different types of game presentations. For example, a single system 100 may include EPSs 103 adapted to provide the display indicated by the payout table in FIG. 11 while other EPSs in the system may be adapted to provide the display indicated by the payout table in FIG. 12. All of these EPSs 103 submit game play requests for the very same bingo games. That is, a bingo game played according to the present invention may be played with, for example, seven game play requests originating from EPSs 103 adapted to provide the display indicated in the payout table shown in FIG. 11 and eight game play requests originating from EPSs 103 adapted to provide the display indicated in the payout table shown in FIG. 12. This multiple game presentation arrangement is facilitated by requiring the same game ending pattern for each EPS 103, regardless of the presentation it may provide. The bonus prizes available in the bingo game and the patterns that provide those bonus prizes may vary dramatically from one game presentation, that is, one EPS 103, to the next. Thus, in a particular bingo game played through system 100, the prize awarded to a particular bingo pattern achieved for a game play request will depend upon the particular EPS 103 from which the game play request originated. Furthermore, game play requests at different buy in levels may all participate in the same bingo games. For example, a given bingo game according to the present invention may be played by five players at a one credit buy in level, six players at a two credit buy in level, and four players at a three credit buy in level.

The above described preferred embodiments are intended to illustrate the principles of the invention, but not to limit the scope of the invention. Various other embodiments and modifications to these preferred embodiments may be made by those skilled in the art without departing from the scope of the invention. For example, a system according to the present invention may include components other than those shown for purposes of example in FIG. 1. In particular, some gaming systems may require that players open an account at a point of sale terminal prior to logging in to the system and playing games at the various EPSs 103. Also, some preferred forms of the invention may include an intermediate computer or controller in communication with both the LAS 102 at a gaming facility and the EPSs 103 and point of sale terminals at the gaming facility. Several different intermediate computers or controllers may be configured in the system at a gaming facility, each dedicated to servicing a different set of EPSs 103 and point of sale terminals. These intermediate computers may help facilitate communications between the EPSs 103 and the LAS 102 and between the point of sale terminal and the LAS 102, and may also handle accounting and credit management functions in the system.

The invention claimed is:

1. A method for conducting bingo-type games, the method including the steps of:

(a) defining a first play characteristic class in terms of a first result claiming action time range and defining a second play characteristic class in terms of a second result claiming action time range, each result claiming action time range comprising a range of times for taking one or more actions to claim a result in a bingo game;

(b) receiving a number of game play requests in a bingo gaming system;

(c) associating at least some of the game play requests with the first play characteristic class and associating other of the game play requests with the second play characteristic class, the association of each respective game play request with the respective play characteristic class being made based on historical player result claiming action time;

(d) segregating each received game play request associated with the first play characteristic class into a first game play group and each received game play request associated with the second play characteristic class into a second game play group; and (e) conducting a first game with the first game play group when the first game play group contains sufficient game play requests to represent a quorum for the first game play group, and conducting a second game with the second game play group when the second game play group contains sufficient game play requests to represent a quorum for the second game play group.

2. The method of claim 1 further including the steps of:

(a) receiving a number of additional game play requests in the bingo gaming system;

(b) associating at least some of the additional game play requests with the first play characteristic class and associating other of the additional game play requests with the second play characteristic class, the association of each respective additional game play request with the respective play characteristic class being made based on historical player result claiming action time;

(c) segregating the received additional game play requests associated with a respective one of the play characteristic classes into a respective additional game play group to form additional first and additional second game play groups; and (d) conducting an additional game with the additional first game play group when the additional first game play group contains sufficient game play requests to represent a quorum for the additional first game play group, and conducting an additional game with the additional second game play group when the additional second game play group contains sufficient game play requests to represent a quorum for the additional second game play group.

3. The method of claim 1 further including for at least some players in the bingo gaming system, monitoring a suitable metric for result claiming action time for the respective players.

4. The method of claim 1 wherein the step of associating at least some of the game play requests with the first play characteristic class and associating other of the game play requests with the second play characteristic class includes conducting a table lookup based upon an identity associated with a respective received game play request.

5. The method of claim 1 wherein the step of associating at least some of the game play requests with the first play characteristic class and associating other of the game play requests with the second play characteristic class includes adding a class identifier to a respective game play request at the production of the respective game play request at a player station.

6. The method of claim 1 wherein the step of associating at least some of the game play requests with the first play characteristic class and associating other of the game play requests with the second play characteristic class is performed based on a player identifier assigned to a respective player.

7. The method of claim 1 wherein the step of associating at least some of the game play requests with the first play characteristic class and associating other of the game play requests with the second play characteristic class is performed based on a play session identifier assigned for a respective play session at a player station in the bingo gaming system.

8. A method for conducting bingo-type games, the method including the steps of:

(a) defining a first play characteristic class in terms of a first result claiming action time range and defining a second play characteristic class in terms of a second result claiming action time range, each result claiming action time range comprising a range of times for taking one or more actions to claim a result in a bingo game;

(b) associating each of a number of game play requests in a bingo gaming system with the first play characteristic class or the second play characteristic class, the association of each respective game play request with the respective play characteristic class being made based on historical player result claiming action time, and each of the number of game play requests being initiated by a respective player in the bingo gaming system;

(c) collecting the game play requests associated with the first play characteristic class into a first game play group, and, simultaneously with collecting the game play requests associated with the first play characteristic class into the first game play group, collecting the game play requests associated with the second play characteristic class into a second game play group;

(d) conducting a first bingo-type game with the first game play group when the first game play group contains sufficient game play requests to represent a quorum for the first game play group; and (e) conducting a second bingo-type game with the second game play group when the second game play group contains sufficient game play requests to represent a quorum for the second game play group.

9. The method of claim 8 further including monitoring the time between a player action prompt for a respective player and the time that the respective player takes a result claiming action.

10. The method of claim 8 wherein the step of associating the game play requests with the first play characteristic class or the second play characteristic class includes conducting a table lookup based upon an identity associated with a respective received game play request.

11. The method of claim 8 wherein the step of associating the game play requests with the first play characteristic class or the second play characteristic class includes adding a class identifier to a respective game play request at the production of the respective game play request at a player station.

12. The method of claim 8 wherein the step of associating the game play requests with the first play characteristic class or the second play characteristic class is performed based on a player identifier assigned to a respective player.

13. The method of claim 8 wherein the step of associating the game play requests with the first play characteristic class or the second play characteristic class is performed based on a play session identifier assigned for a respective play session at a player station in the bingo gaming system.

14. A system for conducting bingo-type games, the system including:

(a) a plurality of electronic player stations, each electronic player station for producing a respective game play request in response to a player input at the respective electronic player station; and (b) a server in communication with each electronic player station in the plurality of electronic player stations, the server for (i) defining multiple play characteristic classes, each respective play characteristic class being defined in terms of a respective result claiming action time range, each respective result claiming action time range comprising a range of times for taking one or more actions to claim a result in a bingo game, for (ii) associating each respective game play request with a respective one of the play characteristic classes based on historical player result claiming action time, for (iii) collecting the respective game play requests from the electronic player stations into two or more groups of game play requests by the respective play characteristic class associated with each respective game play request, and for conducting a bingo-type game for each group of game play requests when a minimum quorum number of game play requests are collected for the respective group.

15. The system of claim 14 further including a player characteristic monitoring arrangement for monitoring the player result claiming action time each of a number of players in the system.

16. The system of claim 14 wherein the server produces a data structure relating players in the system to the play characteristic classes.

17. The system of claim 14 wherein the server communicates a player classification indicator to a player station in use by a respective player and wherein the player station in use by that respective player includes the player class indicator with each game play request initiated by that respective player at that player station.

18. The method of claim 14 wherein the server is also for associating the game play requests with a respective play characteristic class on the basis of a play session identifier assigned for a respective play session at a player station in the bingo gaming system.

19. A program product stored on a computer readable medium for conducting bingo-type games, the program product including:

(a) class definition program code for defining a first play characteristic class in terms of a first result claiming action time range and defining a second play characteristic class in terms of a second result claiming action time range, each result claiming action time range comprising a range of times for taking one or more actions to claim a result in a bingo game;

(b) classification program code for associating each of a number of game play requests in a bingo gaming system with the first play characteristic class or the second play characteristic class, the association of each respective game play request with the respective play characteristic class being made based on historical player result claiming action time;

(c) group collecting program code for collecting each game play request associated with the first play characteristic class into a first game play group and for collecting each game play request associated with the second play characteristic class into a second game play group; and (d) game program code for conducting a first bingo-type game with the first game play group when the first game play group contains sufficient game play requests to represent a quorum for the first game play group, the game program code also for conducting a second bingo-type game with the second game play group when the second game play group contains sufficient game play requests to represent a quorum for the second game play group.

20. The program product of claim 19 further including player characteristic monitoring program code for monitoring player activity in the bingo gaming system to obtain result claiming action time information regarding at least some of the players in the bingo gaming system.

* * * * *